US011615751B1

(12) United States Patent
Chen

(10) Patent No.: US 11,615,751 B1
(45) Date of Patent: Mar. 28, 2023

(54) DISPLAY CONTROL CIRCUIT AND BACKLIGHT CONTROL METHOD THEREOF HAVING DYNAMIC BACKLIGHT ADJUSTING MECHANISM

(71) Applicant: REALTEK SEMICONDUCTOR CORPORATION, Hsinchu (TW)

(72) Inventor: Li-Ang Chen, Hsinchu (TW)

(73) Assignee: REALTEK SEMICONDUCTOR CORPORATION, Hsinchu (TW)

( * ) Notice: Subject to any disclaimer, the term of this patent is extended or adjusted under 35 U.S.C. 154(b) by 0 days.

(21) Appl. No.: 17/862,432

(22) Filed: Jul. 12, 2022

(30) Foreign Application Priority Data

Sep. 10, 2021 (TW) ..... 110133864

(51) Int. Cl.
*G09G 3/34* (2006.01)

(52) U.S. Cl.
CPC ... *G09G 3/3406* (2013.01); *G09G 2320/0233* (2013.01); *G09G 2320/0247* (2013.01); *G09G 2320/0257* (2013.01); *G09G 2320/064* (2013.01); *G09G 2320/0626* (2013.01)

(58) Field of Classification Search
CPC ... G09G 2310/0237; G09G 2340/0435; G09G 3/3406; G09G 5/10
See application file for complete search history.

(56) References Cited

U.S. PATENT DOCUMENTS

| | | | | |
|---|---|---|---|---|
| 11,335,288 | B2 | 5/2022 | Chen | |
| 2017/0251170 | A1* | 8/2017 | Kabuto | H04N 5/57 |
| 2017/0343921 | A1* | 11/2017 | Yamaguchi | G03G 15/043 |
| 2019/0147804 | A1* | 5/2019 | Zha | G09G 3/342 345/691 |
| 2021/0304703 | A1* | 9/2021 | Xu | G09G 5/003 |
| 2022/0148535 | A1 | 5/2022 | Chen | |

FOREIGN PATENT DOCUMENTS

TW I744089 B 10/2021

* cited by examiner

*Primary Examiner* — Van N Chow
(74) *Attorney, Agent, or Firm* — WPAT, PC

(57) ABSTRACT

The present invention discloses a backlight control method having dynamic backlight adjusting mechanism used in a display control circuit is provided and includes the steps outlined below. A frame refresh time length of a former frame is obtained. When a current frame is started to be displayed, a backlight module is controlled to output a strobe backlight in a backlight turn-on time period. When an actual display time reaches the frame refresh time length and a next frame is not started to be displayed, the backlight module is controlled to output a constant backlight until the next frame is started to be displayed. When the actual display time does not reach the frame refresh time length and the next frame is started to be displayed, the backlight module is controlled to output the constant backlight until the frame next to the next frame is started to be displayed.

18 Claims, 5 Drawing Sheets

DISPLAY CONTROL CIRCUIT AND BACKLIGHT CONTROL METHOD THEREOF HAVING DYNAMIC BACKLIGHT ADJUSTING MECHANISM

BACKGROUND OF THE INVENTION

1. Field of the Invention

The present invention relates to a display control circuit and a backlight control method thereof having dynamic backlight adjusting mechanism.

2. Description of Related Art

In current LCD monitors, the common frame refreshing technology is hold-type display. As a result, when an object moves in the frame, a motion blur condition occurs since the tracking speed of the eyes and the frame refresh rate do not match each other.

In order to address the motion blur issue, a strobe backlight is used in the LCD monitors. More specifically, the backlight module turns on and off within a short time period to keep the frame black for a certain time. The blur condition observed by the eyes can therefore be reduced. However, when a variable refresh rate (VRR) technology is used, the backlight module is not able to maintain the steadiness of the frame brightness due to the dynamic variation of the time length of the display frames. Flickers may therefore be generated.

SUMMARY OF THE INVENTION

In consideration of the problem of the prior art, an object of the present invention is to supply a display control circuit and a backlight control method thereof having dynamic backlight adjusting mechanism.

The present invention discloses a backlight control method having dynamic backlight adjusting mechanism used in a display control circuit, wherein the display control circuit is configured to receive an image signal from an image source, generate a plurality of display frames to a display panel to be displayed thereon and generate a backlight control signal to a backlight module to turn on or turn off the backlight module. The backlight control method includes steps outlined below. A frame refresh time length of a former frame is obtained by the display control circuit. The backlight module is controlled to output a strobe backlight having a predetermined brightness in a backlight turn-on time period by the display control circuit when a current frame is started to be displayed. Whether an actual display time of the current frame reaches the frame refresh time length and whether a next frame is started to be displayed are determined by the display control circuit. The backlight module is controlled by the display control circuit, when the actual display time reaches the frame refresh time length and when the next frame is not started to be displayed, to output a constant backlight having a compensation brightness to maintain the predetermined brightness until the next frame is started to be displayed. The backlight module is controlled by the display control circuit, when the actual display time does not reach the frame refresh time length and when the next frame is started to be displayed, to output the constant backlight having the compensation brightness after the actual display time reaches the frame refresh time length to maintain the predetermined brightness until a further next frame is started to be displayed.

The present invention also discloses a display control circuit having dynamic backlight adjusting mechanism and electrically coupled to a display panel and a backlight module. The display control circuit is configured to perform steps outlined below. An the image signal IS received from an image source, a plurality of display frames are generated to the display panel to be displayed thereon and a backlight control signal is generated to the backlight module to turn on or turn off the backlight module. A frame refresh time length of a former frame is obtained. The backlight module is controlled to output a strobe backlight having a predetermined brightness in a backlight turn-on time period when a current frame is started to be displayed. Whether an actual display time of the current frame reaches the frame refresh time length and whether a next frame is started to be displayed are determined. The backlight module is controlled, when the actual display time reaches the frame refresh time length and when the next frame is not started to be displayed, to output a constant backlight having a compensation brightness to maintain the predetermined brightness until the next frame is started to be displayed. The backlight module is controlled, when the actual display time does not reach the frame refresh time length and when the next frame is started to be displayed, to output the constant backlight having the compensation brightness after the actual display time reaches the frame refresh time length to maintain the predetermined brightness until a further next frame is started to be displayed.

These and other objectives of the present invention will no doubt become obvious to those of ordinary skill in the art behind reading the following detailed description of the preferred embodiments that are illustrated in the various figures and drawings.

DETAILED DESCRIPTION OF THE PREFERRED EMBODIMENTS

An aspect of the present invention is to provide a display control circuit and a backlight control method thereof having dynamic backlight adjusting mechanism to control the backlight module to maintain the same average brightness by using the display control circuit under the condition that the refresh frequency of the display frames changes such that the strobe backlight can be implemented.

Figure 1:
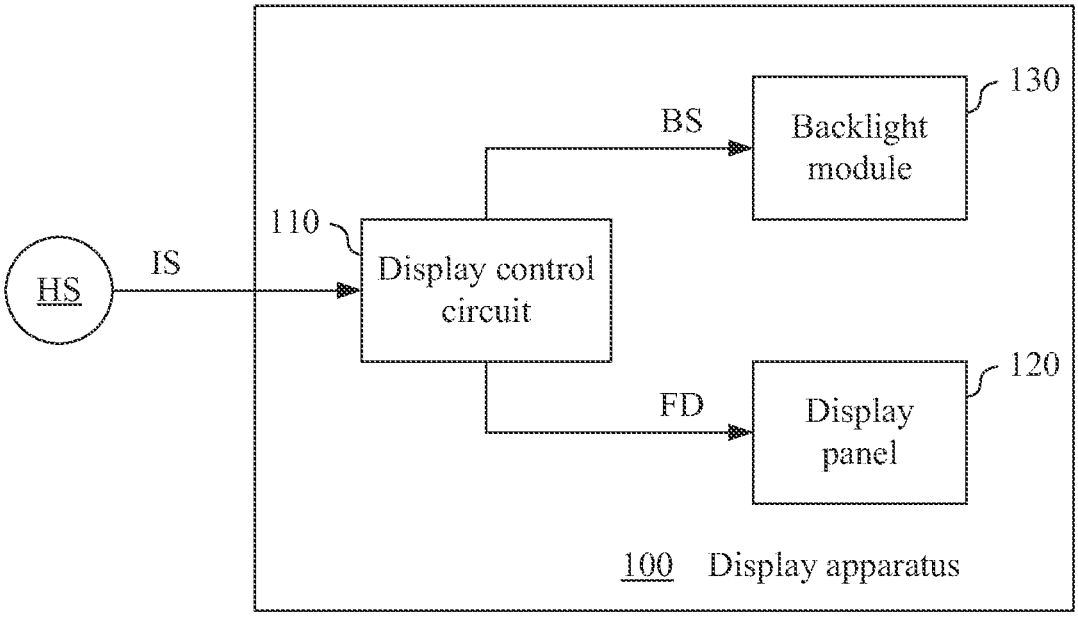
FIG. 1 illustrates a block diagram of a display apparatus according to an embodiment of the present invention.

Reference is now made to FIG. 1. FIG. 1 illustrates a block diagram of a display apparatus 100 according to an embodiment of the present invention. The display apparatus 100 includes a display control circuit 110 having dynamic backlight adjusting mechanism, a display panel 120 and a backlight module 130.

In an embodiment, the display control circuit 110 is a scaler. However, the present invention is not limited thereto. The display control circuit 110 is electrically coupled to the display panel 120 and the backlight module 130 inside the display apparatus 100, and is electrically coupled to an image source HS (e.g., a host terminal) outside of the display apparatus 100. The display control circuit 110 is configured to receive an image signal IS from the image source HS, generate a plurality of display frames FD to the display panel 120 to be displayed thereon and generate a backlight control signal BS to the backlight module 130 to turn on or turn off the backlight module 130. In an embodiment, the display control circuit 110 is coupled to the display panel 120 through a display driver IC, and is coupled to the backlight module 130 through a backlight driver IC. However, the present invention is not limited thereto.

In another embodiment, the display panel 120 and the backlight module 130 are integrated in the same display module. However, the present invention is not limited thereto.

More specifically, the display control circuit 110 controls the display panel 120 to receive the display frames FD, such that the display panel 120 displays a plurality of display frames in different frame refresh time periods according to a frame refresh frequency. The frame refresh time length of each of the display frames is reciprocal of a corresponding frame refresh frequency. In an embodiment, the frame refresh frequency varies based on practical requirements. As a result, the frame refresh time length varies along with the variation of the frame refresh frequency.

On the other hand, in order to solve the problem of motion blur generated due to the mismatch of an eye-tracking speed of human and a display refresh rate, the display control circuit 110 uses the backlight control signal BS to control the backlight module 130 to accomplish strobe backlight mechanism, in which the backlight module 130 turns on in a backlight turn-on time period within each of the frame refresh time periods of the display frames to light up the display panel 120, and the backlight module 130 turns off outside of the backlight turn-on time period.

The operation of the dynamic backlight adjusting mechanism of the display apparatus 100 is described in detail in the following paragraphs in accompany with FIG. 2.

Figure 2:
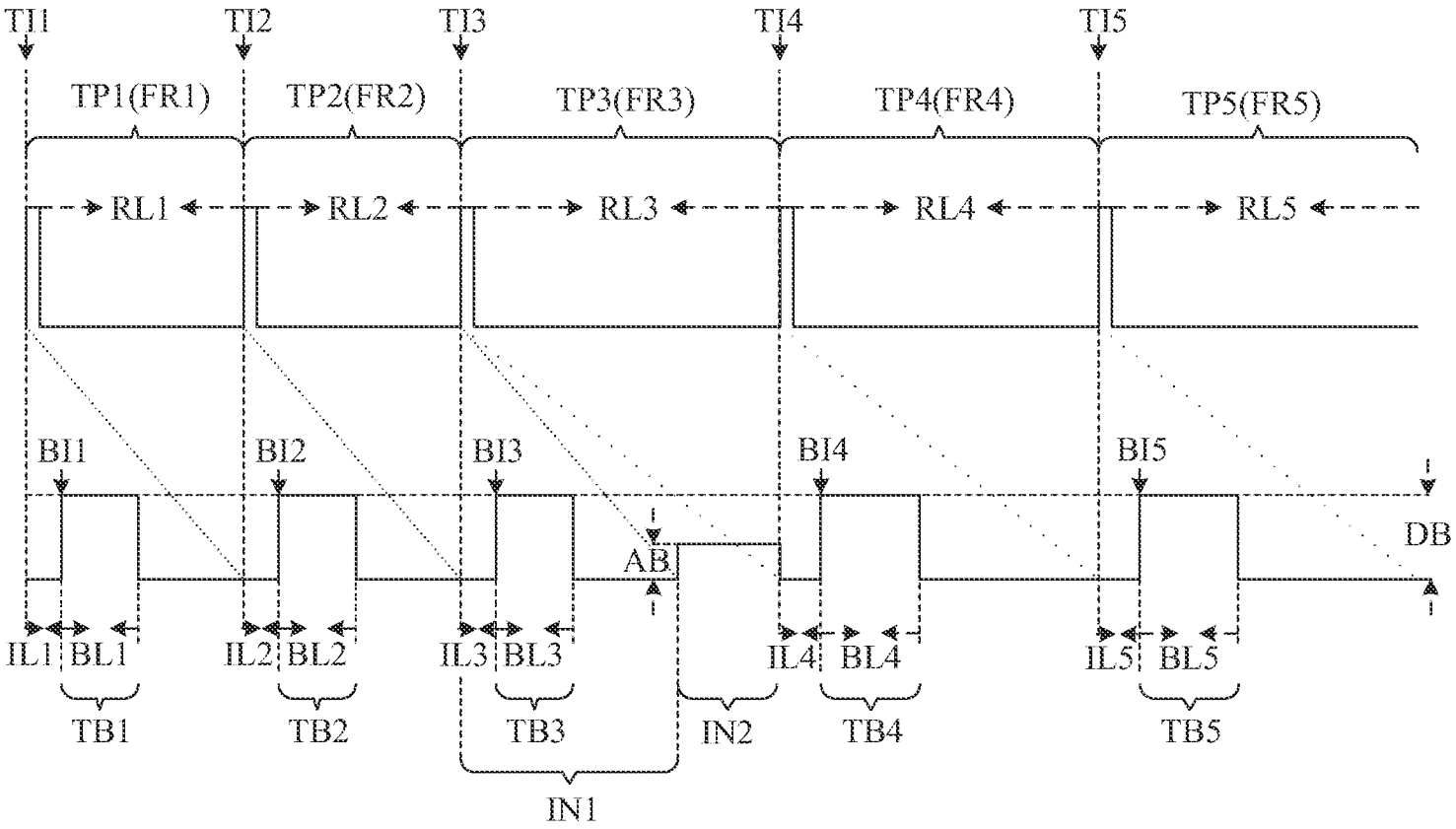
FIG. 2 illustrates a timing diagram related to the operation of the display apparatus according to an embodiment of the present invention.

Reference is now made to FIG. 2. FIG. 2 illustrates a timing diagram related to the operation of the display apparatus 100 according to an embodiment of the present invention.

In FIG. 2, the timings of the operation of the display panel 120 and the backlight module 130 are illustrated. Corresponding to the operation timing of the display panel 120, frame refresh time periods TP1~TP5 of a plurality of display frames FR1~FR5 are illustrated in FIG. 2. Corresponding to the operation timing of the backlight module 130, backlight turn-on intervals of a plurality of backlight turn-on time periods TB1~TB5 are illustrated in FIG. 2, in which the height of each of these backlight turn-on intervals represents the intensity of the brightness of the backlight module 130.

As described above, after receiving the image signal IS, the display control circuit 110 generates respective display frames FR1~FR5 of the display frames FD in the frame refresh time periods TP1~TP5 according to the frame refresh frequency. Each of initial refresh time spots TI1~TI5 of the frame refresh time periods TP1~TP5 is defined by a corresponding V-sync signal (as illustrated by the signals in the upper half part of FIG. 2). The frame refresh time periods TP1~TP5 have frame refresh time lengths RL1~RL5, and the reciprocal of the frame refresh time lengths RL1~RL5 equals to the frame refresh frequency.

Further, the display control circuit 110 controls the backlight module 130 to turn on in the backlight turn-on time periods TB1~TB5. Each of initial time lengths IL1~IL5 are presented between each of corresponding pairs of the initial backlight time spots BI1~BI5 of the backlight turn-on time periods TB1~TB5 and the initial refresh time spots TI1~TI5 of the frame refresh time periods TP1~TP5. The backlight turn-on time periods TB1~TB5 have turn-on time lengths BL1~BL5.

In the present embodiment, each of the display frames FR1 and FR2 is displayed with a first frame refresh frequency. Each of the display frame FR3 to the display frame FR5 is displayed with a second frame refresh frequency. The second frame refresh frequency is smaller than the first frame refresh frequency. As a result, each of the frame refresh time lengths RL3~RL5 of the display frames FR3~FR5 is larger than each of the frame refresh time lengths RL1~RL2 of the display frames FR1~FR2.

The description is made by using the display frames FR3 as a current frame as an example Under such a condition, the display frames FR2 is a former frame, and the display frames FR4 is a next frame.

At first, the display control circuit 110 obtains the frame refresh time length RL2 of the former frame FR2.

In an embodiment, the display control circuit 110 accumulates a number of H-sync signals (not illustrated in the figure) of the former frame RF2 to obtain the frame refresh time length RL2.

In another embodiment, when the image source HS in FIG. 1 is equipped with a corresponding function, the display control circuit 110 may directly retrieve refresh frequency information (not illustrated in the figure) from the image signal IS to obtain the frame refresh time length RL2.

When the current frame FR3 begins, the display control circuit 110 controls the backlight module 130 to output a strobe backlight having a predetermined brightness DB in the backlight turn-on time period TB3. A plurality of time parameters of the backlight turn-on time period TB3 is configured according to the relation of a plurality of predetermined time ratio parameters relative to the frame refresh time length RL2.

In an embodiment, the time parameters include an initial time length and a turn-on time length. The predetermined time ratio parameters include an initial time ratio and a turn-on time ratio.

The initial time ratio determines a ratio between the initial time length and the frame refresh time length, wherein the initial time length is the time difference between the initial backlight time spot of the backlight turn-on time period and the initial refresh time spot of the frame refresh time period. Take current frame FR2 as an example, such a ratio is the ratio IL2/RL2 between the initial time length IL2 and the frame refresh time length RL2, wherein the initial time length IL2 is the time difference between the initial backlight time spot BI2 of the backlight turn-on time period TB2 and the initial refresh time spot TI2 of the frame refresh time period TP2.

The turn-on time ratio determines a ratio between the turn-on time length of the backlight turn-on time period and the frame refresh time length of the frame refresh time period. Take the current frame FR3 as an example, such a ratio is the ratio BL2/RL2 between the turn-on time length BL2 of the backlight turn-on time period TB2 and the frame refresh time length RL2 of the frame refresh time period TP2.

In an embodiment, in order to control the backlight module 130 to provide a backlight having a steady brightness (e.g., the predetermined brightness DB), the time parameters corresponding to each of the display frames is configured to have the fixed predetermined time ratio parameters relative to the frame refresh time length.

As a result, corresponding to the current frame FR3, the display control circuit 110 configures the initial time length IL3 according to the relation of the initial time ratio relative to the frame refresh time length RL2, such that the initial time length IL3 and the initial time length IL2 are the same. Further, corresponding to the current frame FR3, the display control circuit 110 configures the turn-on time length BL3 according to the relation of the turn-on time ratio relative to the frame refresh time length RL2, such that the turn-on time length BL3 and the turn-on time length BL2 are the same.

Subsequently, the display control circuit 110 determines whether an actual display time of the current frame FR3 reaches the frame refresh time length and whether the next frame FR4 is started to be displayed.

As illustrated in FIG. 2, in the frame refresh time period TP3 that corresponds to the display frame FR3, a first interval IN1 having a time length that equals to the frame refresh time length RL2 is included. After the first interval IN1 is finished, the display control circuit 110 determines that the actual display time of the current frame FR3 reaches the frame refresh time length RL2 and determines that the next frame FR4 is not started to be displayed. The display control circuit 110 further controls the backlight module 130 to output a constant backlight having a compensation brightness to maintain the predetermined brightness until the next frame FR4 is started to be displayed.

As a result, in the second interval IN2 in the frame refresh time period TP3, which is from the time spot that the first interval IN1 finishes to the time spot that the display frames FR4 is started to be displayed, the backlight module 130 outputs the constant backlight having the compensation brightness AB. In an embodiment, the intensity of the compensation brightness AB equals to the intensity of the average brightness of the strobe backlight within the first interval IN1, in which the strobe backlight is actually outputted in the backlight turn-on time period TB3.

Figure 3:
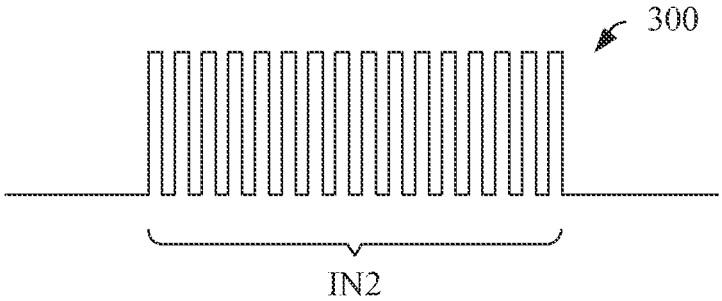
FIG. 3 illustrates an actual output waveform when the display control circuit controls the backlight module to output the constant backlight according to an embodiment of the present invention.

Reference is now made to FIG. 3. FIG. 3 illustrates an actual output waveform 300 when the display control circuit 110 controls the backlight module 130 to output the constant backlight according to an embodiment of the present invention.

As illustrated in FIG. 3, when the display control circuit 110 controls the backlight module 130 to output the constant backlight having the compensation brightness, the display control circuit 110 can control the backlight module 130 to output constant backlight according to a pulse width modulation (PWM) waveform having a frequency larger than a predetermined frequency to generate the actual output waveform 300, in which the pulse width modulation waveform and the strobe backlight have the same duty cycle. The compensation brightness AB in FIG. 2 is an equivalent brightness of the actual output waveform 300.

By using the constant backlight that having the duration varying with the actual display time, the brightness of the frame can be kept steady without flickering.

After the next frame FR4 is started to be displayed, the display control circuit 110 sets the display frames FR4 as the current frame and sets the display frames FR3 as the former frame to keep performing processing.

Under such a condition, the display control circuit 110 obtains the frame refresh time length RL3 of the former frame FR3. The display control circuit 110 controls the backlight module 130 to output the strobe backlight having the predetermined brightness DB in the backlight turn-on time period TB4 when the current frame FR4 is started to be displayed. The time parameters of the backlight turn-on time period TB4 are configured according to the relation of the predetermined time ratio parameters relative to the frame refresh time length RL3. The content of the predetermined time ratio parameters and the configuration of the time parameters are identical to those described previously. The detail is thus not described herein.

As a result, corresponding to the current frame FR4, the display control circuit 110 configures the initial time length IL4 according to the relation of the initial time ratio relative to the frame refresh time length RL3, such that the initial time length IL4 is larger than the initial time length IL3. Further, corresponding to the current frame FR4, the display control circuit 110 configures the turn-on time length BL4 according to the relation of the turn-on time ratio relative to the frame refresh time length RL3, such that the turn-on time length BL4 is larger than the turn-on time length BL3. However, since the initial time ratio and the turn-on time ratio are fixed, the average brightness of the backlight module 130 corresponding to each of the display frames FR4 and the display frames FR3 is the same.

Subsequently, the display control circuit 110 determines whether an actual display time of the current frame FR4 reaches the frame refresh time length and whether the next frame FR5 is started to be displayed.

The display control circuit 110 does not perform compensation when the actual display time reaches the frame refresh time length RL4 and when the next frame FR5 is started to be displayed. After the next frame FR5 is started to be displayed, the display control circuit 110 sets the display frames FR5 as the current frame and sets the display frames FR4 as the former frame to perform further processing. The detail is not described herein.

Figure 4:
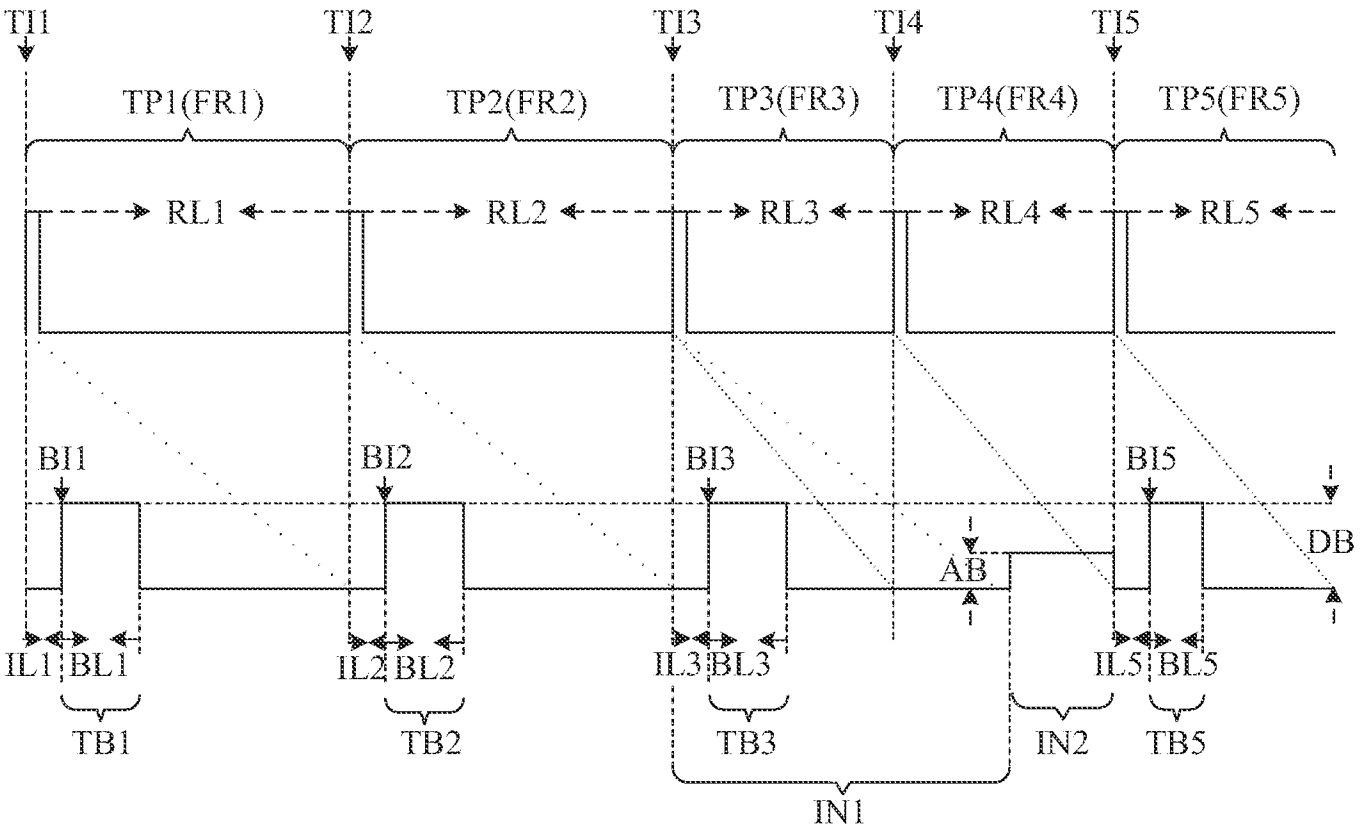
FIG. 4 illustrates a timing diagram related to the operation of the display apparatus according to another embodiment of the present invention.

Reference is now made to FIG. 4. FIG. 4 illustrates a timing diagram related to the operation of the display apparatus 100 according to another embodiment of the present invention.

Similar to FIG. 2, the frame refresh time periods TP1~TP5 of the display frames FR1~FR5 and the backlight turn-on intervals of the backlight turn-on time periods TB1~TB5 are illustrated in FIG. 4. The height of each of these backlight turn-on intervals represents the intensity of the brightness of the backlight module 130. The definition of each of the parameters related to the frame refresh time periods TP1~TP5 and the backlight turn-on time period TB1~TB3 and TB5 is the same as that defined in FIG. 2. The detail is thus not described herein.

In the present embodiment, each of the display frames FR1 and FR2 is displayed with a first frame refresh frequency. Each of the display frame FR3 to the display frame FR5 is displayed with a second frame refresh frequency. The second frame refresh frequency is larger than the first frame refresh frequency. As a result, each of the frame refresh time lengths RL3~RL5 of the display frames FR3~FR5 is smaller than each of the frame refresh time lengths RL1~RL2 of the display frames FR1~FR2.

The description is made by using the display frames FR3 as a current frame as an example Under such a condition, the display frames FR2 is a former frame, and the display frames FR4 is a next frame.

At first, the display control circuit 110 obtains the frame refresh time length RL2 of the former frame FR2. When the current frame FR3 begins, the display control circuit 110 controls the backlight module 130 to output a strobe backlight having a predetermined brightness DB in the backlight turn-on time period TB3. The time parameters of the backlight turn-on time period TB3 is configured according to a relation of a plurality of predetermined time ratio parameters relative to the frame refresh time length RL2. The content of the predetermined time ratio parameters and the configuration of the time parameters are identical to those described previously. As a result, the detail is not described herein.

Subsequently, the display control circuit 110 determines whether an actual display time of the current frame FR3 reaches the frame refresh time length and whether the next frame FR4 is started to be displayed.

As illustrated in FIG. 4, in the frame refresh time periods TP3 and TP4 that correspond to the display frames FR3 and FR4, the first interval IN1 having a time length that equals to the frame refresh time length RL2 is included.

When next frame FR4 is started to be displayed, the display control circuit 110 determines that actual display time does not reach the frame refresh time length RL2 and the next frame FR4 is started to be displayed. The display control circuit 110 further controls the backlight module 130 output the constant backlight having the compensation brightness after the actual display time reaches the frame refresh time length RL2 to maintain the predetermined brightness until a further next frame FR5 is started to be displayed, in which the term "further next" means the next two frame relative to the current frame.

As a result, in the second interval IN2 in the frame refresh time period TP3, which is from the time spot that the first interval IN1 finishes to the time spot that the display frames FR5 is started to be displayed, the backlight module 130 outputs the constant backlight having the compensation brightness AB. The output of the constant backlight and the configuration of the compensation brightness AB are identical to those described previously. As a result, the detail is not described herein.

When the further next frame FR5 is started to be displayed, the display control circuit 110 sets display frames FR5 as the current frame and sets the display frames FR4 as the former frame to keep performing processing.

Under such a condition, the display control circuit 110 obtains the frame refresh time length RL4 of the former frame FR4. When the current frame FR5 is started to be displayed, the display control circuit 110 controls the backlight module 130 to output the strobe backlight having the predetermined brightness DB in the backlight turn-on time period TB4. The time parameters of the backlight turn-on time period TB5 are configured according to the relation of the frame refresh time length RL4 relative to the predetermined time ratio parameters.

As a result, corresponding to the current frame FR5, the display control circuit 110 configures the initial time length IL5 according to the relation of the initial time ratio relative to the frame refresh time length RL4, such that the initial time length IL5 is smaller than the initial time length IL3. Further, corresponding to the current frame FR5, the display control circuit 110 configures the turn-on time length BL5 according to the relation of the turn-on time ratio relative to the frame refresh time length RL4, such that the turn-on time length BL5 is smaller than the turn-on time length BL3. However, since the initial time ratio and the turn-on time ratio are fixed, the average brightness of the backlight module 130 corresponding to each of the display frames FR5 and the first interval IN1.

Subsequently, if a subsequent display frame is presented after the display frames FR5, the display control circuit 110 can set the subsequent display frame as the current frame and set the display frames FR5 as the former frame to keep performing processing. The detail is not further described herein.

The display apparatus of the present invention controls the backlight module to maintain the same average brightness by using the display control circuit under the condition that the refresh frequency of the display frames changes such that the strobe backlight can be implemented.

Figure 5:
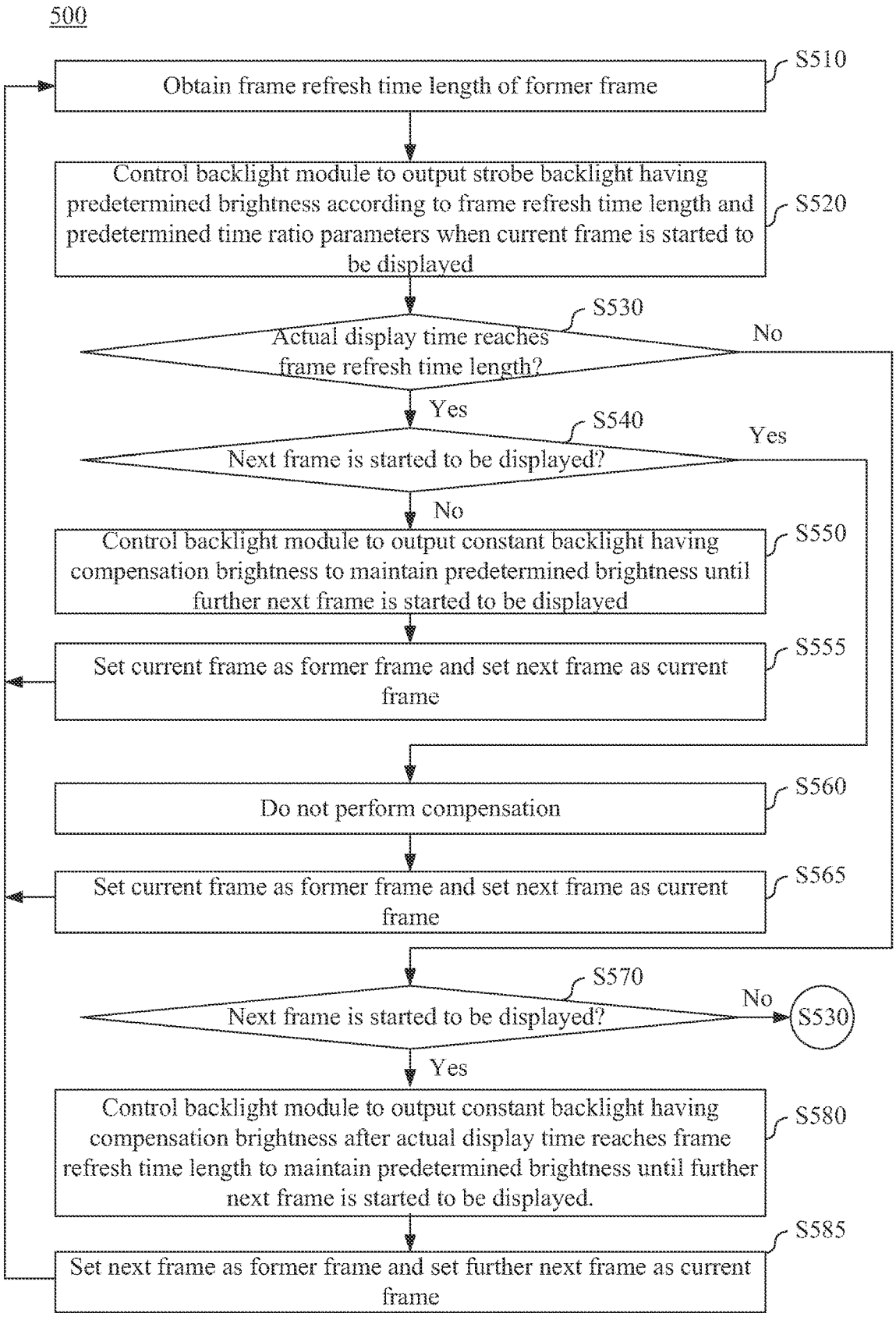
FIG. 5 illustrates a flow chart of a backlight control method having dynamic backlight adjusting mechanism according to an embodiment of the present invention.

Reference is now made to FIG. 5. FIG. 5 illustrates a flow chart of a backlight control method 500 having dynamic backlight adjusting mechanism according to an embodiment of the present invention.

In addition to the apparatus described above, the present disclosure further provides the backlight control method 500 that can be used in such as, but not limited to, the display apparatus 100 in FIG. 1. As illustrated in FIG. 5, an embodiment of the backlight control method 500 includes the following steps.

In step S510, the frame refresh time length of the former frame is obtained by the display control circuit 110.

In step S520, the backlight module 130 is controlled to output the strobe backlight having the predetermined brightness according to the frame refresh time length and the predetermined time ratio parameters by the display control circuit 110 when the current frame is started to be displayed.

In step S530, whether the actual display time of the current frame reaches the frame refresh time length is determined by the display control circuit 110.

In step S540, when the actual display time reaches the frame refresh time length, whether the next frame is started to be displayed is determined by the display control circuit 110.

In step S550, when the actual display time reaches the frame refresh time length and when the next frame is not started to be displayed, the backlight module 130 is controlled to output the constant backlight having the compensation brightness by the display control circuit 110 to maintain the predetermined brightness until the further next frame is started to be displayed.

In step S555, when the next frame is started to be displayed, the current frame is set as the former frame and the next frame is set as the current frame by the display control circuit 110. The flow further goes back to step S510 to perform the backlight control method 500.

In step S560, when the actual display time reaches the frame refresh time length and when the next frame is started to be displayed, the compensation is not performed by the display control circuit 110.

In step S565, the current frame is set as the former frame and the next frame is set as the current frame by the display control circuit 110. The flow further goes back to step S510 to perform the backlight control method 500.

In step S570, when the actual display time of the current frame is determined to not reach the frame refresh time length by the display control circuit 110, whether the next frame is started to be displayed is determined.

In step S580, when the actual display time does not reach the frame refresh time length and when the next frame is started to be displayed, the backlight module 130 is controlled to output the constant backlight having the compensation brightness after the actual display time reaches the frame refresh time length to maintain the predetermined brightness by the display control circuit 110 until the further next frame is started to be displayed.

In step S585, the next frame is set as the former frame and further next frame is set as the current frame by the display control circuit 110. The flow further goes back to step S510 to perform the backlight control method 500.

When the actual display time is determined to not reach the frame refresh time length and when the next frame is determined to be not started to be displayed in step 570, the flow goes back to step S530 to keep performing determination.

It is appreciated that the embodiments described above are merely an example. In other embodiments, it should be appreciated that many modifications and changes may be made by those of ordinary skill in the art without departing, from the spirit of the disclosure.

In summary, the present invention discloses the display control circuit and the backlight control method thereof having dynamic backlight adjusting mechanism that control the backlight module to maintain the same average brightness by using the display control circuit under the condition that the refresh frequency of the display frames changes such that the strobe backlight can be implemented.

The aforementioned descriptions represent merely the preferred embodiments of the present invention, without any intention to limit the scope of the present invention thereto. Various equivalent changes, alterations, or modifications based on the claims of present invention are all consequently viewed as being embraced by the scope of the present invention.

What is claimed is:

1. A backlight control method having dynamic backlight adjusting mechanism used in a display control circuit, wherein the display control circuit is configured to receive an image signal from an image source, generate a plurality of display frames to a display panel to be displayed thereon and generate a backlight control signal to a backlight module to turn on or turn off the backlight module, the backlight control method comprises:

obtaining a frame refresh time length of a former frame by the display control circuit;

controlling the backlight module to output a strobe backlight having a predetermined brightness in a backlight turn-on time period by the display control circuit when a current frame is started to be displayed;

determining, by the display control circuit, whether an actual display time of the current frame reaches the frame refresh time length and whether a next frame is started to be displayed;

controlling the backlight module by the display control circuit, when the actual display time reaches the frame refresh time length and when the next frame is not started to be displayed, to output a constant backlight having a compensation brightness to maintain the predetermined brightness until the next frame is started to be displayed; and controlling the backlight module by the display control circuit, when the actual display time does not reach the frame refresh time length and when the next frame is started to be displayed, to output the constant backlight having the compensation brightness after the actual display time reaches the frame refresh time length to maintain the predetermined brightness until a further next frame is started to be displayed.

2. The backlight control method of claim 1, wherein a plurality of time parameters of the backlight turn-on time period are configured according to the frame refresh time length and a plurality of predetermined time ratio parameters, and the time parameters comprise an initial time length and a turn-on time length, the predetermined time ratio parameters comprise an initial time ratio and a turn-on time ratio;

the initial time ratio determines a ratio between the initial time length and the frame refresh time length, wherein the initial time length is a time difference between an initial backlight time spot of the backlight turn-on time period and an initial refresh time spot of a frame refresh time period; and the turn-on time ratio determines a ratio between the turn-on time length of the backlight turn-on time period and the frame refresh time length.

3. The backlight control method of claim 1, further comprising:

accumulating a number of H-sync signals of the former frame by the display control circuit to obtain the frame refresh time length.

4. The backlight control method of claim 1, further comprising:

retrieving refresh frequency information from the image signal by the display control circuit to obtain the frame refresh time length.

5. The backlight control method of claim 1, further comprising:

not performing compensation by the display control circuit when the actual display time reaches the frame refresh time length and when the next frame is started to be displayed.

6. The backlight control method of claim 1, further comprising:

controlling the backlight module to output the constant backlight according to a pulse width modulation (PWM) waveform by the display control circuit when the backlight module is controlled to output the constant backlight having the compensation brightness, wherein the pulse width modulation waveform and the strobe backlight have a same duty cycle.

7. The backlight control method of claim 1, wherein a first intensity of the compensation brightness equals to a second intensity of an average brightness of the strobe backlight in the frame refresh time length.

8. The backlight control method of claim 1, further comprising:

determining, by the display control circuit, whether the next frame is started to be displayed according to whether a V-sync signal is received by the display control circuit.

9. The backlight control method of claim 1, further comprising:

setting the current frame as the former frame and setting the next frame as the current frame by the display control circuit when the actual display time reaches the frame refresh time length and when the next frame is started to be displayed;

setting the current frame as the former frame and setting the next frame as the current frame by the display control circuit when the backlight module is controlled to output the constant backlight until the next frame is started to be displayed; and setting the next frame as the former frame and setting the further next frame as the current frame by the display control circuit when the backlight module is controlled to output the constant backlight until the further next frame is started to be displayed.

10. A display control circuit having dynamic backlight adjusting mechanism and electrically coupled to a display panel and a backlight module, the display control circuit configured to:

receive an image signal from an image source, generate a plurality of display frames to the display panel to be displayed thereon and generate a backlight control signal to the backlight module to turn on or turn off the backlight module;

obtain a frame refresh time length of a former frame;

control the backlight module to output a strobe backlight having a predetermined brightness in a backlight turn-on time period when a current frame is started to be displayed;

determine whether an actual display time of the current frame reaches the frame refresh time length and whether a next frame is started to be displayed;

control the backlight module, when the actual display time reaches the frame refresh time length and when the next frame is not started to be displayed, to output a constant backlight having a compensation brightness to maintain the predetermined brightness until the next frame is started to be displayed; and control the backlight module, when the actual display time does not reach the frame refresh time length and when the next frame is started to be displayed, to output the constant backlight having the compensation brightness after the actual display time reaches the frame refresh time length to maintain the predetermined brightness until a further next frame is started to be displayed.

11. The display control circuit of claim 10, wherein a plurality of time parameters of the backlight turn-on time period are configured according to the frame refresh time length and a plurality of predetermined time ratio parameters, and the time parameters comprise an initial time length and a turn-on time length, the predetermined time ratio parameters comprise an initial time ratio and a turn-on time ratio;

the initial time ratio determines a ratio between the initial time length and the frame refresh time length, wherein the initial time length is a time difference between an initial backlight time spot of the backlight turn-on time period and an initial refresh time spot of a frame refresh time period; and the turn-on time ratio determines a ratio between the turn-on time length of the backlight turn-on time period and the frame refresh time length.

12. The display control circuit of claim 10, wherein the display control circuit is further configured to:

accumulate a number of H-sync signals of the former frame by the display control circuit to obtain the frame refresh time length.

13. The display control circuit of claim 10, wherein the display control circuit is further configured to:

retrieve refresh frequency information from the image signal by the display control circuit to obtain the frame refresh time length.

14. The display control circuit of claim 10, wherein the display control circuit is further configured to:

not perform compensation by the display control circuit when the actual display time reaches the frame refresh time length and when the next frame is started to be displayed.

15. The display control circuit of claim 10, wherein the display control circuit is further configured to:

control the backlight module to output the constant backlight according to a pulse width modulation waveform by the display control circuit when the backlight module is controlled to output the constant backlight having the compensation brightness, wherein the pulse width modulation waveform and the strobe backlight has a same duty cycle.

16. The display control circuit of claim 10, wherein a first intensity of the compensation brightness equals to a second intensity of an average brightness of the strobe backlight in the frame refresh time length.

17. The display control circuit of claim 10, wherein the display control circuit is further configured to:

determine whether the next frame is started to be displayed according to whether a V-sync signal is received by the display control circuit.

18. The display control circuit of claim 10, wherein the display control circuit is further configured to:

set the current frame as the former frame and setting the next frame as the current frame by the display control circuit when the actual display time reaches the frame refresh time length and when the next frame is started to be displayed;

set the current frame as the former frame and setting the next frame as the current frame by the display control circuit when the backlight module is controlled to output the constant backlight until the next frame is started to be displayed; and set the next frame as the former frame and setting the further next frame as the current frame by the display control circuit when the backlight module is controlled to output the constant backlight until the further next frame is started to be displayed.

* * * * *